US005456394A

United States Patent [19]

Israel

[11] Patent Number: 5,456,394

[45] Date of Patent: Oct. 10, 1995

[54] LOAD-ASSIST DEVICE FOR PERSONS CARRYING CARGO BOXES

[76] Inventor: Darryl Israel, 2059 W. Jefferson Blvd., Los Angeles, Calif. 90018

[21] Appl. No.: 218,817

[22] Filed: Mar. 28, 1994

[51] Int. Cl.[6] ..... A45F 5/00

[52] U.S. Cl. ..... 224/270; 224/163; 224/252

[58] Field of Search ..... 224/163, 270, 224/253, 252, 44.5, 902

[56] References Cited

U.S. PATENT DOCUMENTS

| | | | |
|---|---|---|---|
| 947,024 | 1/1910 | Paine et al. | 224/270 |
| 984,402 | 2/1911 | Tuttle | 224/270 X |
| 3,317,097 | 5/1967 | Giordano | 224/253 X |
| 4,319,704 | 3/1982 | Rosen | 224/270 |
| 4,901,898 | 2/1990 | Colombo et al. | 224/270 X |

FOREIGN PATENT DOCUMENTS

| | | | |
|---|---|---|---|
| 10111 | 6/1889 | United Kingdom | 224/270 |

*Primary Examiner*—Renee S. Luebke
*Attorney, Agent, or Firm*—Erik M. Arnhem

[57] ABSTRACT

A portable load carrying device is attachable to a person's belt to provide a support ledge for a box or other cargo item being carried by the person. The weight of the cargo is borne at least partially by the load carrying device, such that stress on the person's arms and back is considerably reduced.

3 Claims, 2 Drawing Sheets

LOAD-ASSIST DEVICE FOR PERSONS CARRYING CARGO BOXES

BACKGROUND OF THE INVENTION

1. Field of the Invention

This invention relates to a device attachable to a person's belt for at least partially supporting the weight of a box, or other item of cargo, while the person is carrying the box from one place to another.

2. Prior Developments

Persons often have to carry heavy boxes or other items of cargo from one place to another. In many cases this requirement is job-related, as in the case of grocery stock resupply people, department store personnel, post office workers, trucking loader, unloader people, package delivery persons, etc.

In some instances the boxes can be quite heavy, such that considerable stress is exerted on the person's arm muscles and back muscles. Also, if the box is relatively large the person may have difficulty in getting his hands under the center of gravity of the box so as to prevent the box from toppling forward out of the person's control.

There is a need for a device that can be attached to a person's body for partially supporting heavy boxes while the person is attempting to move such boxes from one place to another place, whereby there is lessened stress on the person's back or arms.

SUMMARY OF THE INVENTION

The present invention relates to a cargo load assist device that comprises a load-support member having load-support surface, and two belt attachment clips, whereby the load support member can be fastened to a person's belt to partially support the weight of a heavy box, or other cargo item, while the person is attempting to move the box from one place to another place. The load-support member is adapted to underlie a bottom edge of the cargo box, such that the weight of the box is borne primarily by the load-support member and the belt to which it is attached; the person can use his hands primarily for the purpose of retaining the box on the load-support member, so that there is minimal stress on the person's arms and back.

The load assist device can be used for supporting various types of cargo, e.g. heavy boxes, chairs, small tables, large bottles, drums filled with paint, asphalt or other heavy material, small filing cabinets, small windows, automotive batteries, tote boxes, metal castings, and stacks of books.

THE DRAWINGS

Figure 1:
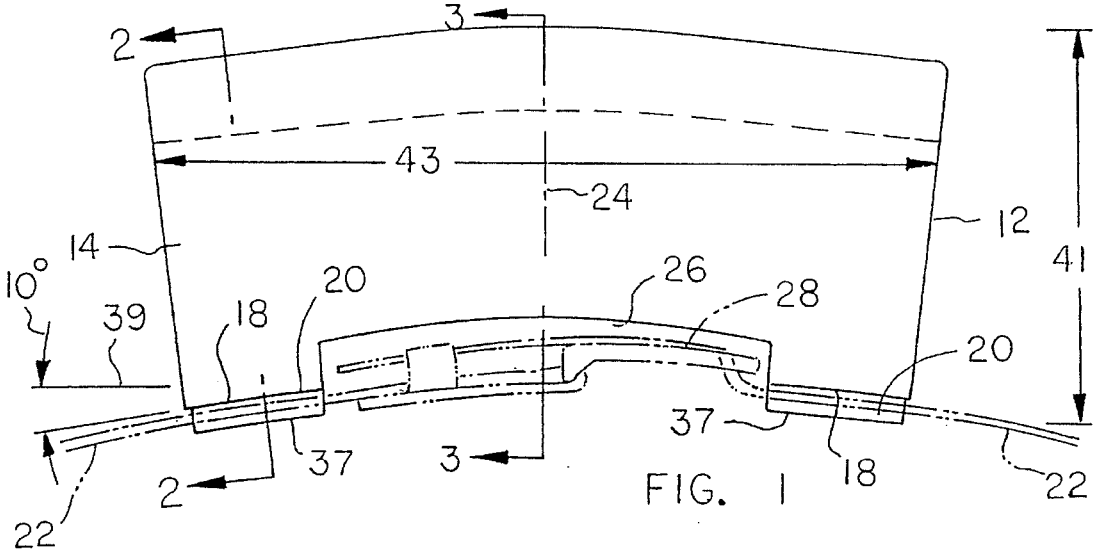
FIG. 1 is a top plan view of a load assist device constructed according to the invention.
Figure 6:
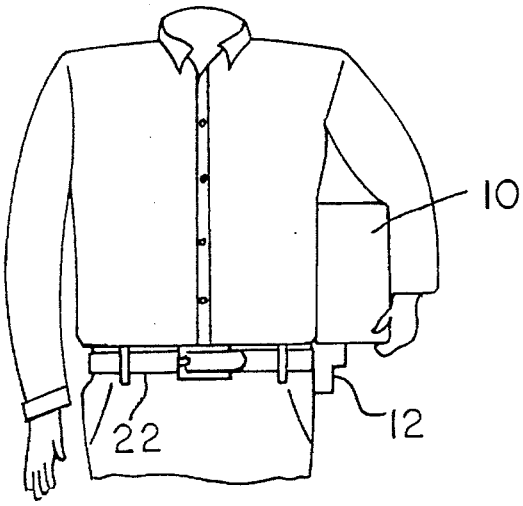

FIG. 6 a view of the FIG. 1 load assist device, taken on a reduced scale and showing the device attached to a person's belt at the hip, whereby a cargo box can be supported at the person's side while he is transporting the box from one place to another place.

DESCRIPTION OF A PREFERRED EMBODIMENT OF THE INVENTION

Figure 2:
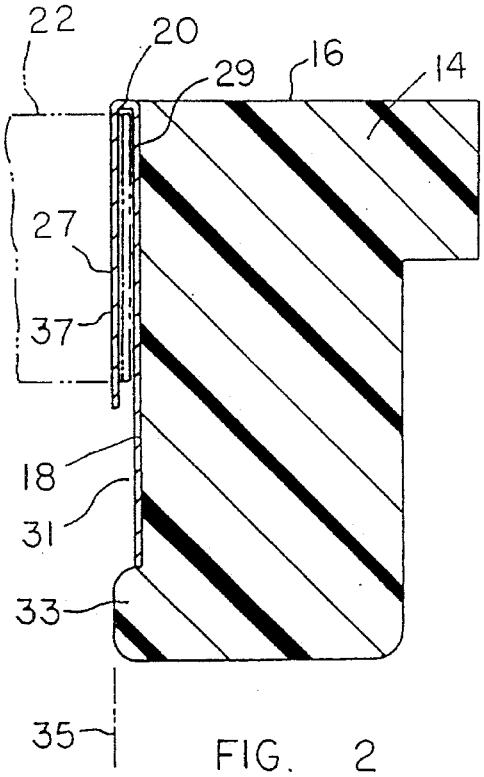
FIG. 2 is a sectional view taken on line 2—2 in FIG. 1.
Figure 3:
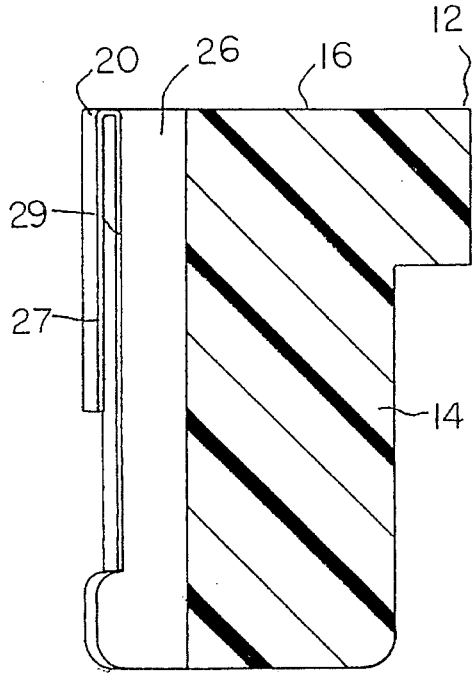
FIG. 3 is a sectional view taken on line 3—3 in FIG. 1.

FIGS. 1 through 3 show the construction of a cargo load assist device usable by a person while the person is carrying cargo from one place to another.

Figure 4:
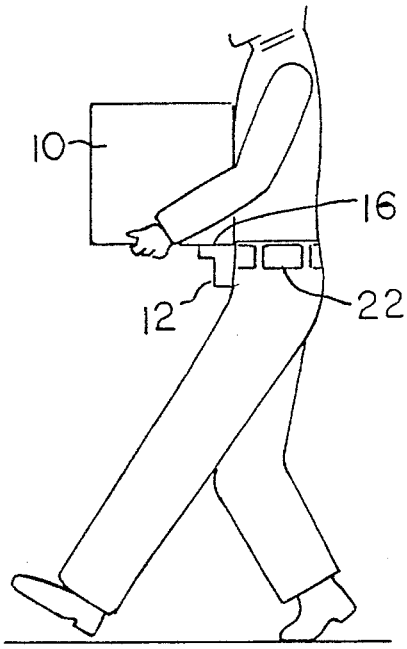
FIG. 4 is a side view of the FIG. 1 load assist device, taken on a reduced scale, and showing the device attached to the belt of a person, whereby the person is enabled to move a box from one point to another point, with lessened stress on the person's arms and back.
Figure 5:
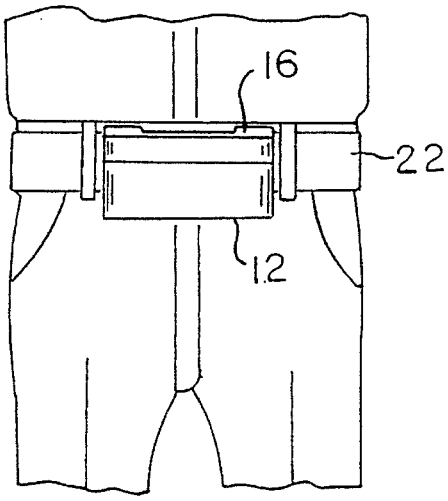
FIG. 5 is a front view of the FIG. 1 load assist device, taken on a reduced scale, and showing the device attached to the person's belt.

FIG. 4 shows the load assist device 12 attached to the person's belt to provide a ledge located in front of the belt buckle; the person has his hands located underneath a cargo box 10 that is resting on the ledge provided by the load assist device. The person's hands are used primarily for holding the box on the load assist device 12; the weight of the box is borne primarily by the load assist device, so that stress on the person's back and arms is considerably reduced.

FIG. 6 shows the load assist device 12 positioned on the person's hip, whereby the cargo box 10 can be carried at the person's side. The person holds the cargo box on the load assist device with one end, leaving the other hand free for performing other tasks, e.g. opening a door.

Referring to FIGS. 1 through 3, the load assist device 10 comprises a one piece molded plastic load support member 14 having an upwardly facing ledge surface 16 and a rear surface 18. Two belt-attachment clips 20 are secured to surface 18 for holding the load assist device in front of the person's belt. In FIGS. 1 and 2 the belt is shown by dashed lines, and denoted by numeral 22.

The two clips 20 are spaced apart so as to be equidistant from an imaginary vertical center plane 24, such that the left and right half sections of load support member 14 are mirror images of one another. Rear surface 18 of the load support member has a central recess (or channel) 26 designed to accommodate the buckle 28 of the person's belt. The load assist device can be mounted on the person's belt by holding the plastic member 14 so that belt buckle 28 is located within recess 26. By moving the plastic support member 14 downwardly the clips 20 can be made to engage and slip onto the belt, for attachment of the load assist device to the belt. Each clip 20 can be manufactured so that its rear leg 27 is somewhat shorter than the front leg 29. This provides an access space 31 below the rear leg of each clip that facilitates installation of the clips on the person's belt.

As shown in FIG. 2, a flat-faced protrusion 33 is formed on load support member 14 directly below each clip 20. Each flat-faced protrusion has the same thickness (in the horizontal plane) as the associated clip, whereby the rear faces of the clip and protrusion are in a common vertical plane 35. With this feature, the load assist device tends to lie flat against the person's body, without projecting into the person's skin. There are no projections that might tend to depress the person's skin, to make the device feel uncomfortable.

As viewed in FIG. 1, the rear face 37 of each clip 20 is angled to transverse plane 39 at an angle of about ten degrees. The rear face of each clip 20 is thus angled to center plane 24 an angle of about eighty degrees. The rear faces of the clips collectively have a V-shaped configuration at an included angle of about one hundred sixty degrees (i.e.) twice the eighty degree angulation mentioned above). With this arrangement the clip rear faces 37 conform to the contour of the human body when the load assist device is worn on the person's belt. There is thus very little distortion of the belt due to the presence of the load assist device.

It is believed that the manner of usage of the load assist device is apparent from FIGS. 4 and 6 of the drawings. As shown in FIG. 4, the load assist device is installed on the person's belt directly in front of the belt buckle. The person can carry a cargo box 10 in a position resting on ledge surface 16 of the load assist device. Only a small portion of the load is borne by the person's arms; the stress on the person's back is thus significantly reduced.

FIG. 6 shows the load assist device mounted on the person's belt at the hip. The person uses one hand to maintain the cargo item 10 on the load assist device, leaving his other hand free for other activities, e.g. opening a door or writing a receipt.

The load assist device can be built in various sizes. Typically however, the device will have a front-to-rear dimension 41 of about two inches, and a transverse dimension 43 of about five inches. With such dimensions, the device is small enough to fit into a tool box or a person's pocket.

What is claimed is:

1. A cargo load assist device attachable to a person's belt extending around the person's waist, wherein the belt is equipped with a buckle for securing the belt on the person's body: said load assist device comprising a load-support member having a rear surface, and an upwardly facing ledge surface; and two belt-attachment clips mounted on said rear surface, whereby said load-support member has its ledge surface extending away from the person's waist to support an item of cargo while the person uses his hands to keep the cargo item from toppling off the ledge surface; said rear surface having a central recess located between the two-belt-attachment clips; said recess being sized to accommodate therein the buckle of the belt worn by the person using the load assist device.

2. A cargo load assist device attachable to a person's belt extending around the person's waist, wherein the belt is equipped with a buckle for securing the belt on the person's body: said load assist device comprising a load-support member having a rear surface, and an upwardly facing ledge surface; two belt-attachment clips mounted on said rear surface, whereby said load-support member has its ledge surface extending away from the person's waist to support an item of cargo while the person uses his hands to keep the cargo item from toppling off the ledge surface; each belt attachment clip being formed of sheet material in an inverted U configuration to provide a clip leg (27) extendable behind the person's belt; said load-support member having two protrusions projecting from said rear surface directly below said belt attachment clips; said clips and said protrusions having equivalent thickness dimensions normal to said rear surface; said clips and said protrusions having rear surfaces located in a common vertical plane to minimize any tendency for the cargo load assist device to form depressions in the body of the person wearing the load assist device.

3. A cargo load assist device attachable to a person's belt extending around the person's waist, wherein the belt is equipped with a buckle for securing the belt on the person's body: said load assist device comprising a load-support member having a rear surface, and an upwardly facing ledge surface; two belt-attachment clips mounted on said rear surface, whereby said load-support member has its ledge surface extending away from the person's waist to support an item of cargo while the person uses his hands to keep the cargo item from toppling off the ledge surface; each belt-attachment clip being formed of sheet material in an inverted U configuration, each said clip comprising a front leg (29) secured to the rear surface of said load-support member and a rear leg (27) spaced from said front leg; the rear leg of each clip being shorter than the front leg to form a belt insertional space below the rear leg; said load-support member having two protrusions (33) projecting from said rear surface directly below said belt attachment clips; said clips and said protrusions having equivalent thickness dimensions normal to said rear surface; said clips aand said protrusions having rear surfaces located in a common vertical plane, to minimize any tendency for the cargo load assist device to form depressions in the body of the person wearing the load assist device.

* * * * *